US011987997B1

(12) United States Patent
Winscher

(10) Patent No.: US 11,987,997 B1
(45) Date of Patent: May 21, 2024

(54) TONGUE AND GROOVE TOOL

(71) Applicant: Travis L. Winscher, Royalton, MN (US)

(72) Inventor: Travis L. Winscher, Royalton, MN (US)

( * ) Notice: Subject to any disclaimer, the term of this patent is extended or adjusted under 35 U.S.C. 154(b) by 382 days.

(21) Appl. No.: 17/552,553

(22) Filed: Dec. 16, 2021

(51) Int. Cl.
*E04F 21/22* (2006.01)
*E04F 15/02* (2006.01)

(52) U.S. Cl.
CPC ..... *E04F 21/22* (2013.01); *E04F 15/02038* (2013.01)

(58) Field of Classification Search
CPC ..... E04F 21/22; B66F 15/00
See application file for complete search history.

(56) References Cited

U.S. PATENT DOCUMENTS

| | | | | |
|---|---|---|---|---|
| 1,094,449 | A | 4/1914 | Lauri | |
| 1,161,207 | A | 11/1915 | Hagel | |
| 4,266,586 | A | 5/1981 | Brown | |
| 4,683,631 | A | 8/1987 | Dobbertin | |
| 5,419,535 | A | 5/1995 | Roberts | |
| 5,964,450 | A | 10/1999 | Pasto | |
| 6,843,402 | B2 | 1/2005 | Sims et al. | |
| 7,398,628 | B2 | 7/2008 | Van Horne, Jr. | |
| 7,913,976 | B2 * | 3/2011 | Gaunt | E04F 21/22 254/16 |
| 8,434,738 | B1 * | 5/2013 | Anstett | E04F 21/22 254/12 |
| 8,708,310 | B2 * | 4/2014 | Edgerly | E04F 21/22 52/749.11 |
| 8,789,809 | B2 * | 7/2014 | Lehmann | E04F 21/22 52/749.1 |
| D730,143 | S * | 5/2015 | Davis | D8/88 |
| 10,767,374 | B1 | 9/2020 | Minerd | |
| D990,259 | S * | 6/2023 | Nye | D8/14 |

* cited by examiner

*Primary Examiner* — Lee D Wilson
(74) *Attorney, Agent, or Firm* — Cramer Patent & Design PLLC; Aaron R. Cramer

(57) ABSTRACT

The tongue and groove tool may comprise a moving armature, a stationary armature, a cam armature, and a spring. The tongue and groove tool may be operable to push a next board and a previously installed board together to seat a tongue into a groove during the installation of tongue and groove boards. Actuating a handle when the next board is aligned with the previously installed board, a pushing head of the moving armature is against the next board, and the stationary armature is anchored to a substructure using one or more spikes on the stationary armature may push the moving armature forward relative to the stationary armature, thus pushing the tongue into the groove and closing a gap between the next board and the previously installed board.

20 Claims, 8 Drawing Sheets

TONGUE AND GROOVE TOOL

RELATED APPLICATIONS

None.

FIELD OF THE INVENTION

The present invention relates to a tongue and groove tool.

BACKGROUND OF THE INVENTION

As anyone who performs a lot of physical work will attest, nothing beats having the proper tool for a job. The proper tool can save time, save money, produce a higher quality job, reduce damage to equipment, and provide for the increased safety of the worker. Each field of work has its own type of specialty tools, each performing a specialized task. One field where there has been a need for such a specialized tool is in the installation of tongue and groove planking on walls and ceilings. Even the highest quality lumber is slightly warped, especially when dealing with long pieces of planking such as those sixteen feet (16') long.

This forces the use of perhaps multiple other workers to brute force the lumber into place so that it can be nailed. Even with this extra work, gaps and other inconsistencies remain which are apparent to all who see it for years afterwards. Accordingly, there exists a need for a means by which a tongue and groove planking can be installed on walls and ceilings, without the problems as described above. The development of the tongue and groove tool fulfills this need.

SUMMARY OF THE INVENTION

The inventor has recognized the aforementioned inherent problems and lack in the art and observed that there is a need for a tongue and groove tool that has a moving armature having a moving armature shaft and a pushing head, a stationary armature having a stationary armature shaft, a hammer pad, and one or more spikes, a cam armature operable to push the moving armature forward relative to the stationary armature, and a spring pulling the stationary armature and the moving armature together as the handle is lowered from a vertical position to a horizontal starting position. The moving armature shaft includes a cam axle that projects laterally away from the moving armature shaft adjacent to a rear end of the moving armature shaft, and the pushing head includes one or more attachment apertures for coupling the pushing head to an object the hammer pad is a target for striking with a hammering tool to drive the one or more spikes into a substructure to anchor the stationary armature. The cam armature includes a cam disk and a handle. The handle is an armature that is operable to provide leverage while rotating the cam disk.

The moving armature shaft may be a straight and hollow shaft. The pushing head may be coupled to a front end of the moving armature shaft. The moving armature shaft may include a first set of pin apertures that pass laterally through a plurality of sides of the moving armature shaft adjacent to the pushing head. The spring may be coupled to the moving armature via a front spring pin which may slide through the first set of pin apertures located on the moving armature. The pushing head may be an L-shaped armature that is operable to push against a next board. A rear of the pushing head may be coupled to the moving armature shaft and a top of the pushing head may rest upon on top of the next board during use. The moving armature may be slidably coupled to the stationary armature such that the moving armature slides forward and rearward relative to the stationary armature.

The moving armature shaft and the stationary armature shaft may be square tubing and a plurality of inside dimensions of the moving armature shaft may be larger than a plurality of outside dimensions of the stationary armature shaft such that the stationary armature shaft may slide into and out of the moving armature shaft. The stationary armature shaft may include a thrust ledge that projects laterally away from a midpoint of the stationary armature shaft. The thrust ledge may present a flat surface that may be perpendicular to the stationary armature shaft at the front of the thrust ledge such that the cam disk pushes against the flat surface during use. The stationary armature shaft may include a second set of pin apertures that pass laterally through the sides of the stationary armature shaft adjacent to the front of the stationary armature shaft. The hammer pad may be coupled to the top rear of the stationary armature, above the one or more spikes. The one or more spikes may be one or more downward-pointed projections coupled to the bottom rear of the stationary armature and may be pressed into the substructure to prevent the stationary armature from moving forward or rearwards. The cam disk may be a round disk having a cam disk aperture.

The cam disk may be rotationally coupled to the cam axle of the moving armature via the cam disk aperture. The cam disk aperture may be located off-center such that a point on the perimeter of the cam disk does not follow a circular path around the center of the cam disk when the cam disk rotates. The tongue and groove tool may further comprise a working curve of the cam disk that may push against the thrust ledge of the stationary armature when the cam armature is actuated. A front end of the handle may be coupled to the cam disk such that as the handle is lifted from a horizontal starting position to a vertical position, the cam disk rotates to push the thrust ledge away from the cam axle. A rear of the spring may be coupled to the stationary armature via a rear spring pin which may slide through the second set of pin apertures located on the stationary armature.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
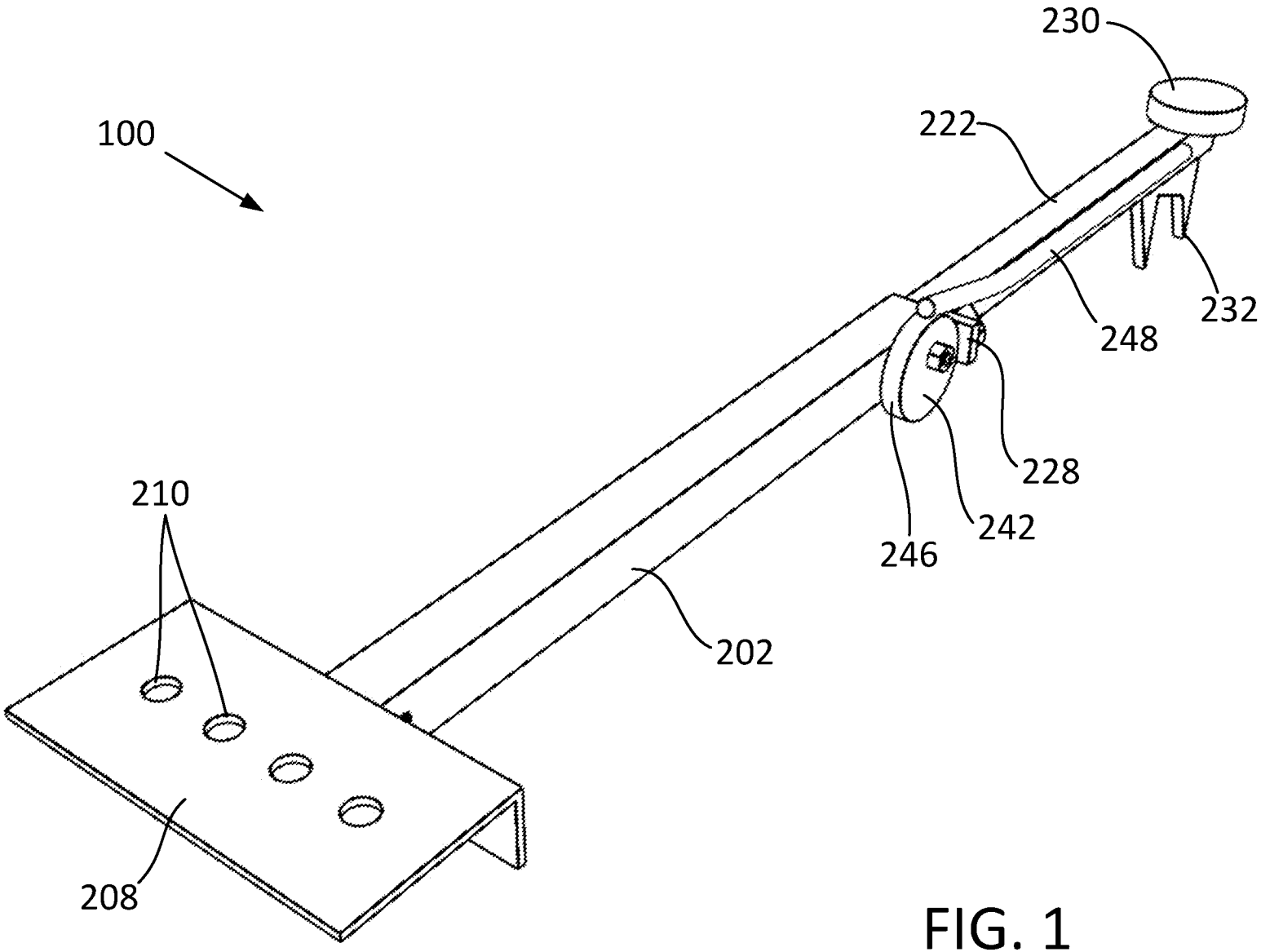
FIG. 1 is an isometric view of a tongue and groove tool, according to an embodiment of the present invention.
Figure 2:
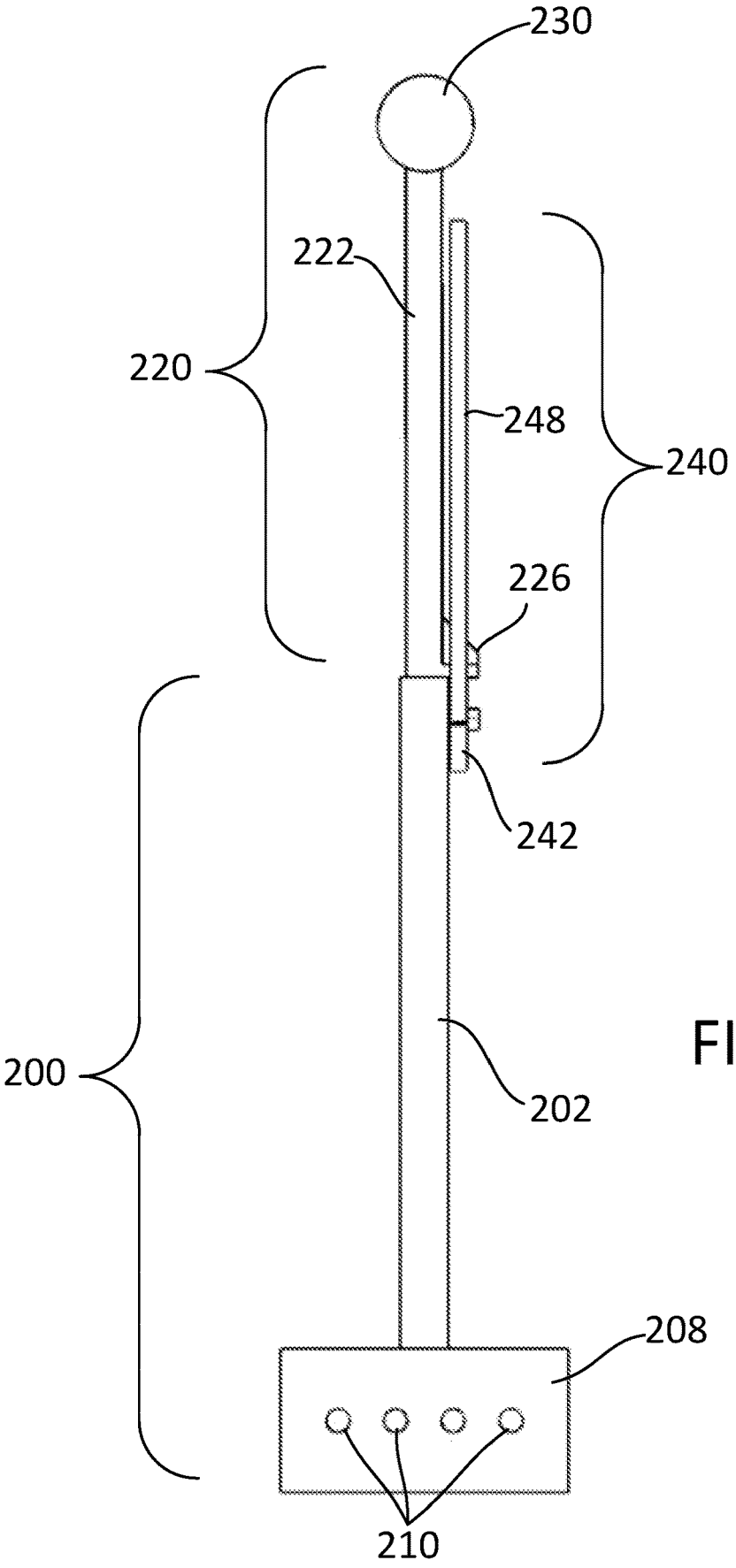
FIG. 2 is a top view of a tongue and groove tool, according to an embodiment of the present invention.
Figure 3:
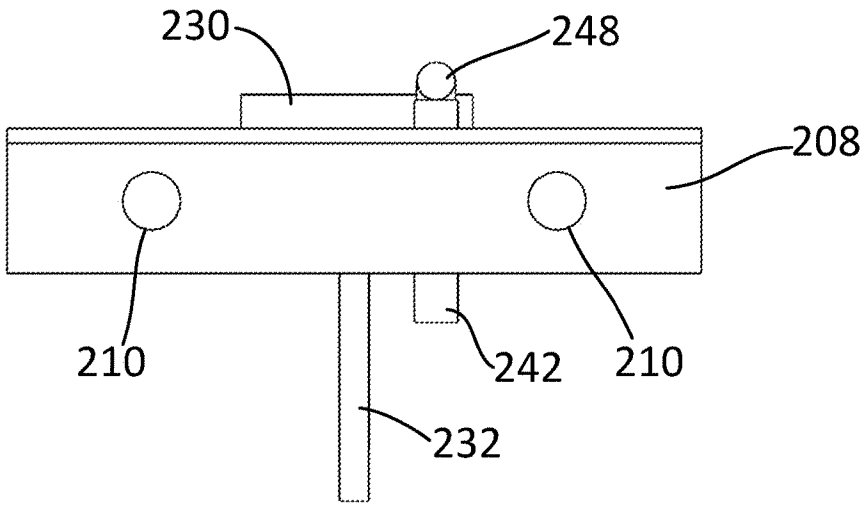
FIG. 3 is a front view of a tongue and groove tool, according to an embodiment of the present invention.
Figure 4:
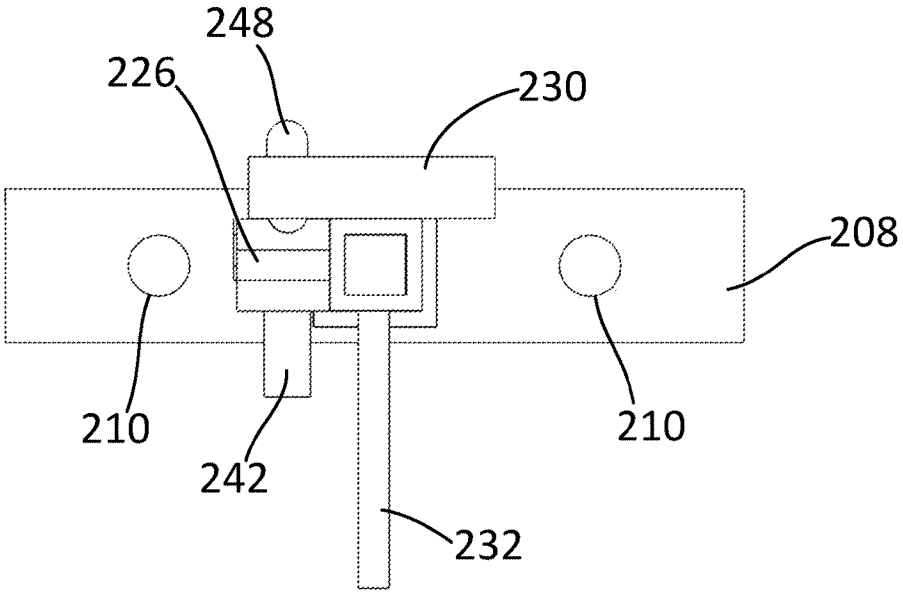
FIG. 4 is a rear view of a tongue and groove tool, according to an embodiment of the present invention.
Figure 5:
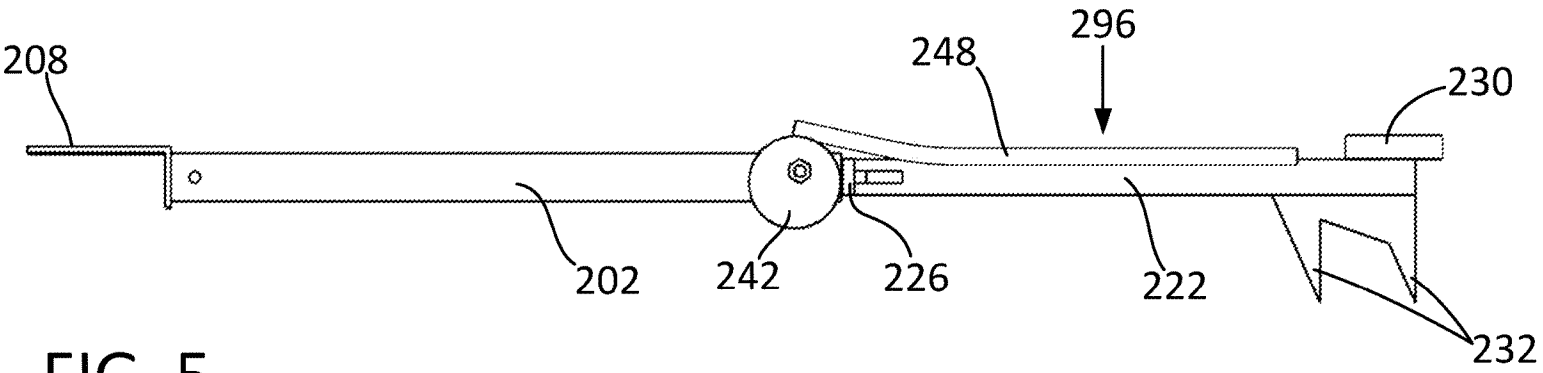
FIG. 5 is a side view of a tongue and groove tool, according to an embodiment of the present invention, illustrating the handle in the horizontal starting position.
Figure 6:
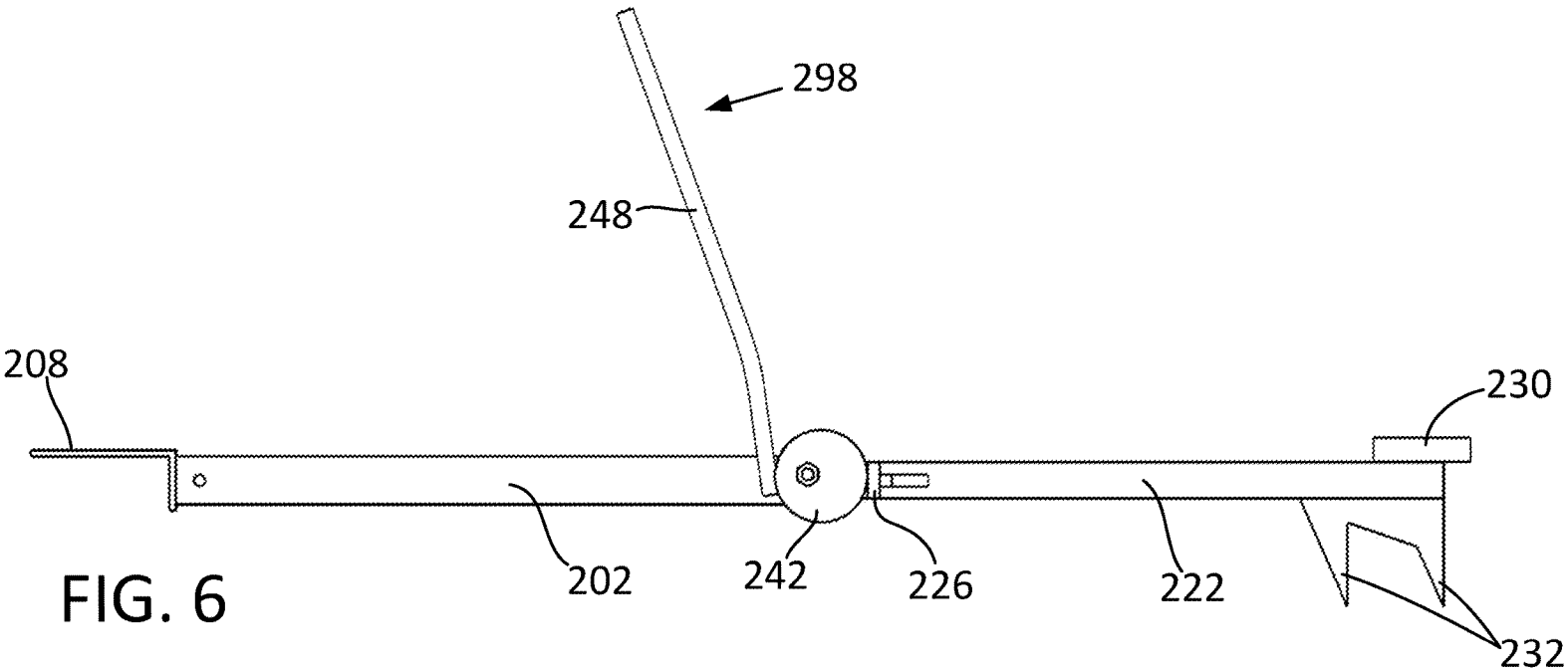
FIG. 6 is a side view of a tongue and groove tool, according to an embodiment of the present invention, illustrating the handle in the vertical position.
Figure 7:
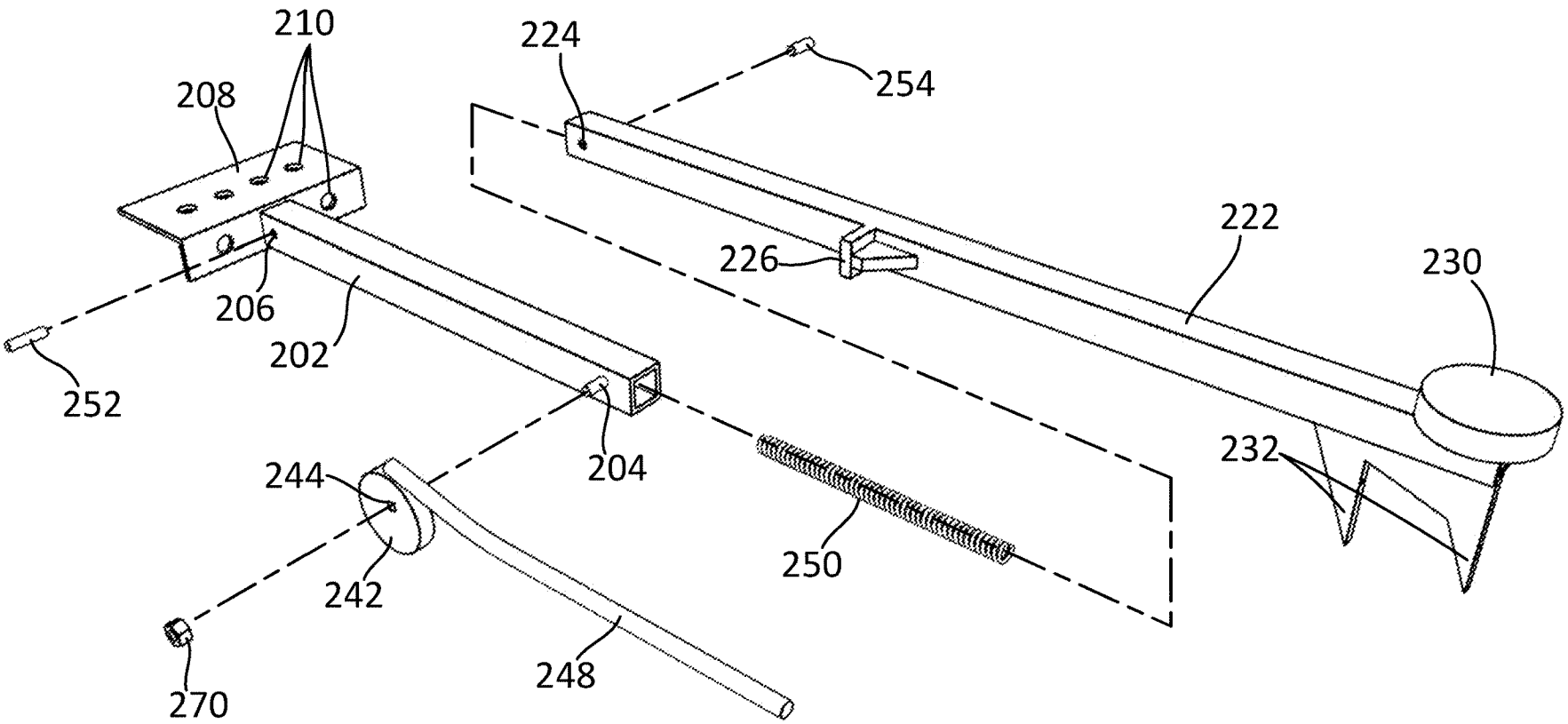
FIG. 7 is an exploded view of a tongue and groove tool, according to an embodiment of the present invention.

100 tongue and groove tool
200 moving armature
202 moving armature shaft
204 cam axle
206 first set of pin apertures
208 pushing head
210 attachment aperture
220 stationary armature
222 stationary armature shaft
224 second set of pin apertures
226 thrust ledge
228 flat surface
230 hammer pad
232 spike
240 cam armature
242 cam disk
244 cam disk aperture
246 working curve
248 handle
250 spring
252 front spring pin
254 rear spring pin
260 pusher block
270 cam retainer
290 gap
292 actuating
294 forward
296 horizontal starting position
298 vertical position
900 tongue and groove boards
910 next board
912 tongue
914 groove
920 previously installed board
940 sub structure

DESCRIPTION OF THE INVENTION

The present invention is directed to a tongue and groove tool (herein described as the "invention") 100. The invention 100 may comprise a moving armature 200, a stationary armature 220, a cam armature 240, and a spring 250. The invention 100 may be operable to push a next board 910 and a previously installed board 920 together to seat a tongue 912 into a groove 914 during the installation of tongue and groove boards 900. Actuating 292 a handle 248 when the next board 910 is aligned with the previously installed board 920, a pushing head 208 of the moving armature 200 is against the next board 910, and the stationary armature 220 is anchored to a substructure 940 using one or more spikes 232 on the stationary armature 220 may push the moving armature 200 forward 294 relative to the stationary armature 220, thus pushing the tongue 912 into the groove 914 and closing a gap 290 between the next board 910 and the previously installed board 920. The invention 100 may be operable to install the tongue and groove boards 900 on a floor, on a wall, or on a ceiling. As non-limiting examples, the substructure 940 may be a subfloor, a floor joist, a wall stud, or a ceiling rafter.

The moving armature 200 may slidably couple to the stationary armature 220 such that the moving armature 200 may slide forward and rearward relative to the stationary armature 220. The moving armature 200 may comprise a moving armature shaft 202 and the pushing head 208. The moving armature shaft 202 may be a straight, hollow shaft. The pushing head 208 may be coupled to the front end of the moving armature shaft 202. The moving armature shaft 202 may comprise a cam axle 204 that projects laterally away from the moving armature shaft 202 adjacent to the rear end of the moving armature shaft 202. The moving armature shaft 202 may comprise a first set of pin apertures 206 that pass laterally through the sides of the moving armature shaft 202 adjacent to the pushing head 208.

The pushing head 208 may be an L-shaped armature that is operable to push against the next board 910. The rear of the pushing head 208 may be coupled to the moving armature shaft 202. The top of the pushing head 208 may rest upon the top of the next board 910 during use. The pushing head 208 may comprise one or more attachment apertures 210 for coupling the pushing head 208 to another object. In a preferred embodiment, two of the one or more attachment apertures 210 may be located on the rear of the pushing head 208, one (1) on either side of the moving armature shaft 202.

The stationary armature 220 may comprise a stationary armature shaft 222, a hammer pad 230, and the one (1) or more spikes 232. The stationary armature shaft 222 may be a straight, hollow shaft. In a preferred embodiment, the moving armature shaft 202 and the stationary armature shaft 222 are both square tubing and the inside dimensions of the moving armature shaft 202 are larger than the outside dimensions of the stationary armature shaft 222 such that the stationary armature shaft 222 may slide into and out of the moving armature shaft 202.

The stationary armature shaft 222 may comprise a thrust ledge 226 that projects laterally away from a midpoint of the stationary armature shaft 222. The thrust ledge 226 may be on the same side (right/left) of the stationary armature shaft 222 as the cam axle 204 on the moving armature shaft 202 such that a cam disk 242 pivoting on the cam axle 204 may push against the thrust ledge 226. The thrust ledge 226 may present a flat surface 228 that is oriented perpendicular to the stationary armature shaft 222 at the front of the thrust ledge 226 such that the cam disk 242 may push against the flat surface 228 during use.

The stationary armature shaft 222 may comprise a second set of pin apertures 224 that pass laterally through the sides of the stationary armature shaft 222 adjacent to the front of the stationary armature shaft 222.

The hammer pad 230 may be a target for striking with a hammering tool. As non-limiting examples, the hammering tool may be a hammer or a mallet. Striking the hammer pad 230 may drive the one or more spikes 232 into the substructure 940 to anchor the stationary armature 220. The hammer pad 230 may be coupled to the top rear of the stationary armature 220, above the one (1) or more spikes 232. In a preferred embodiment, the hammer pad 230 may be a round disk.

The one (1) or more spikes 232 may be one (1) or more downward-pointed projections coupled to the bottom rear of the stationary armature 220. The one (1) or more spikes 232 may be pressed into the substructure 940 to prevent the stationary armature 220 from moving forward or rearwards. The one (1) or more spikes 232 may be removed from the substructure 940 by pulling the rear of the stationary armature 220 away from the substructure 940.

The cam armature 240 may be operable to push the moving armature 200 forward relative to the stationary armature 220. The cam armature 240 may comprise the cam disk 242 and the handle 248. The cam disk 242 may be a round disk comprising a cam disk aperture 244. The cam disk 242 may be rotationally coupled to the cam axle 204 of the moving armature 200 via the cam disk aperture 244. The cam disk aperture 244 may be located off-center such that a point on the perimeter of the cam disk 242 does not follow a circular path around the center of the cam disk 242 when the cam disk 242 rotates. Specifically, a working curve 246 of the cam disk 242 may push against the thrust ledge 226 of the stationary armature 220 when the cam armature 240 is actuated. Because the stationary armature 220 is anchored to the substructure 940 via the one (1) or more spikes 232, the moving armature 200 may be pushed forward by rotation of the cam disk 242. The cam disk 242 may be retained on the cam axle 204 by a cam retainer 270.

The handle 248 may be an armature that is operable to provide leverage while rotating the cam disk 242. The front end of the handle 248 may be coupled to the cam disk 242 such that as the handle 248 is lifted from a horizontal starting position 296 to a vertical position 298 the cam disk 242 rotates to push the thrust ledge 226 away from the cam axle 204.

The spring 250 may be operable to pull the stationary armature 220 and the moving armature 200 together as the handle 248 is lowered from the vertical position 298 to the horizontal starting position 296. The front of the spring 250 may be coupled to the moving armature 200 via a front spring pin 252 which may slide through the first set of pin apertures 206 located on the moving armature 200. The rear of the spring 250 may be coupled to the stationary armature 220 via a rear spring pin 254 which may slide through the second set of pin apertures 224 located on the stationary armature 220. The spring 250 may also be operable to prevent the stationary armature 220 from sliding out of the moving armature 200 as the invention 100 is transported and/or stored.

In some instances, the tongue and groove boards 900 may be oriented such that pushing against the side of the next board 910 where the tongue 912 is located may be necessary. In cases where there is a concern that pressure from the pushing head 208 may deform the tongue 912, a pusher block 260 may be used to protect the tongue 912. The pusher block 260 may be a block that comprises the groove 914 of the tongue and groove boards 900 with the groove 914 oriented away from the pushing head 208 such that the pusher block 260 may straddle the tongue 912 on the next board 910 while the pushing head 208 pushes the pusher block 260 against the next board 910. The pusher block 260 may be coupled to the pushing head 208 using fasteners that pass through the one or more attachment apertures 210 of the pushing head 208 and into the pusher block 260.

In use, a next board 910 may be positioned such that the tongue 912 on the next board 910 is aligned with the groove 914 on the previously installed board 920. Alternatively, the next board 910 may be positioned such that the groove 914 on the next board 910 is aligned with the tongue 912 on the previously installed board 920. The invention 100 may be placed such that the pushing head 208 is against the next board 910, the hammer pad 230 may be struck with the hammering tool to set the one or more spikes 232 into the substructure 940, and the cam armature 240 may be actuated to push the next board 910 into position such that the tongue 912 and the groove 914 engage. The handle 248 may then me moved back to the horizontal starting position 296, the one (1) or more spikes 232 may be pulled away from the substructure 940, and the invention 100 may be moved for use on the next board. If the tongue 912 is exposed to the pushing head 208 during installation, the pusher block 260 may be coupled to the pushing head 208 to protect the tongue 912 from damage.

Figure 8:
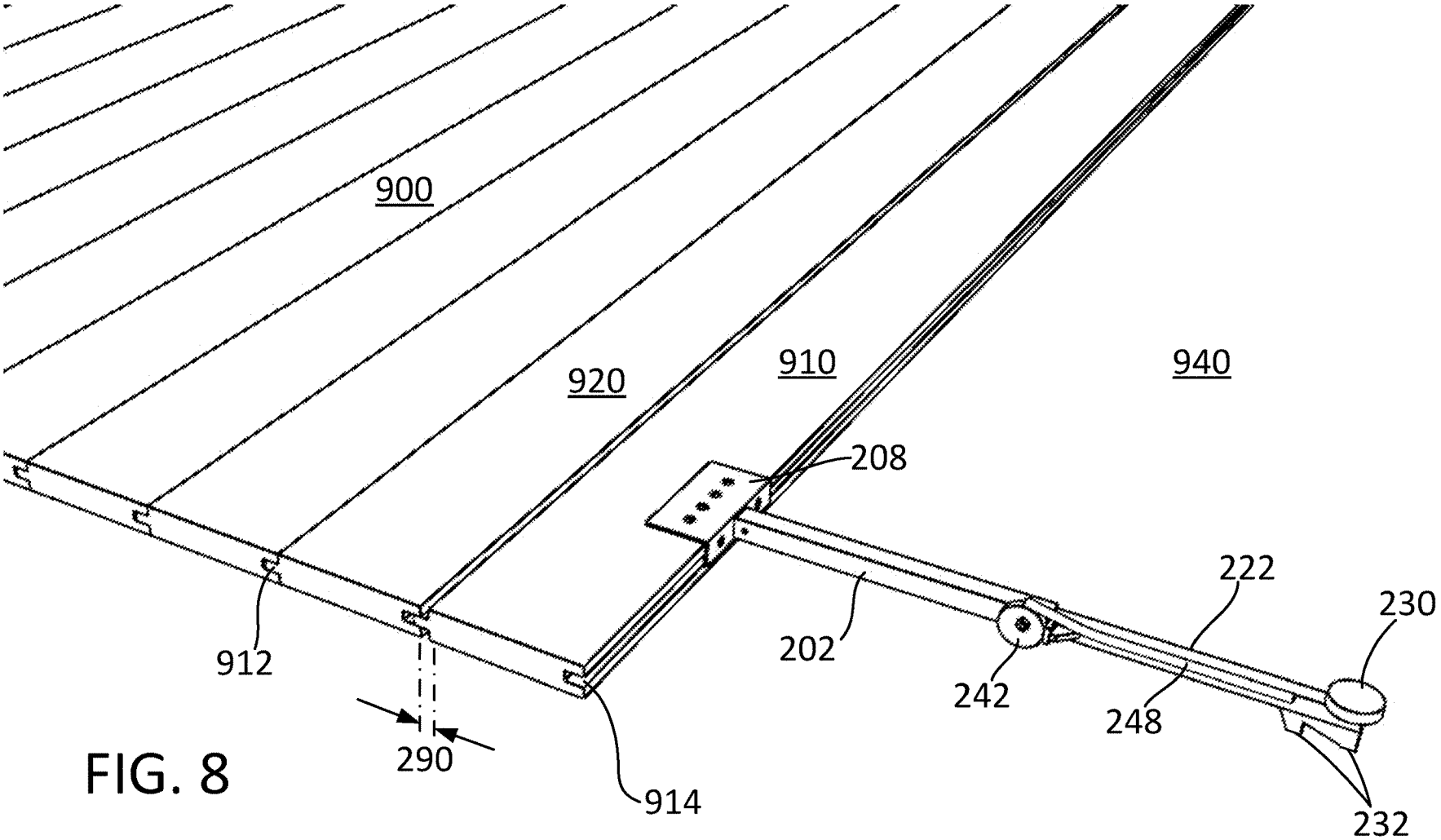
FIG. 8 is an in-use view of a tongue and groove tool, according to an embodiment of the present invention, illustrating a next board in position and about to be pushed into place against a previously installed board.
Figure 9:
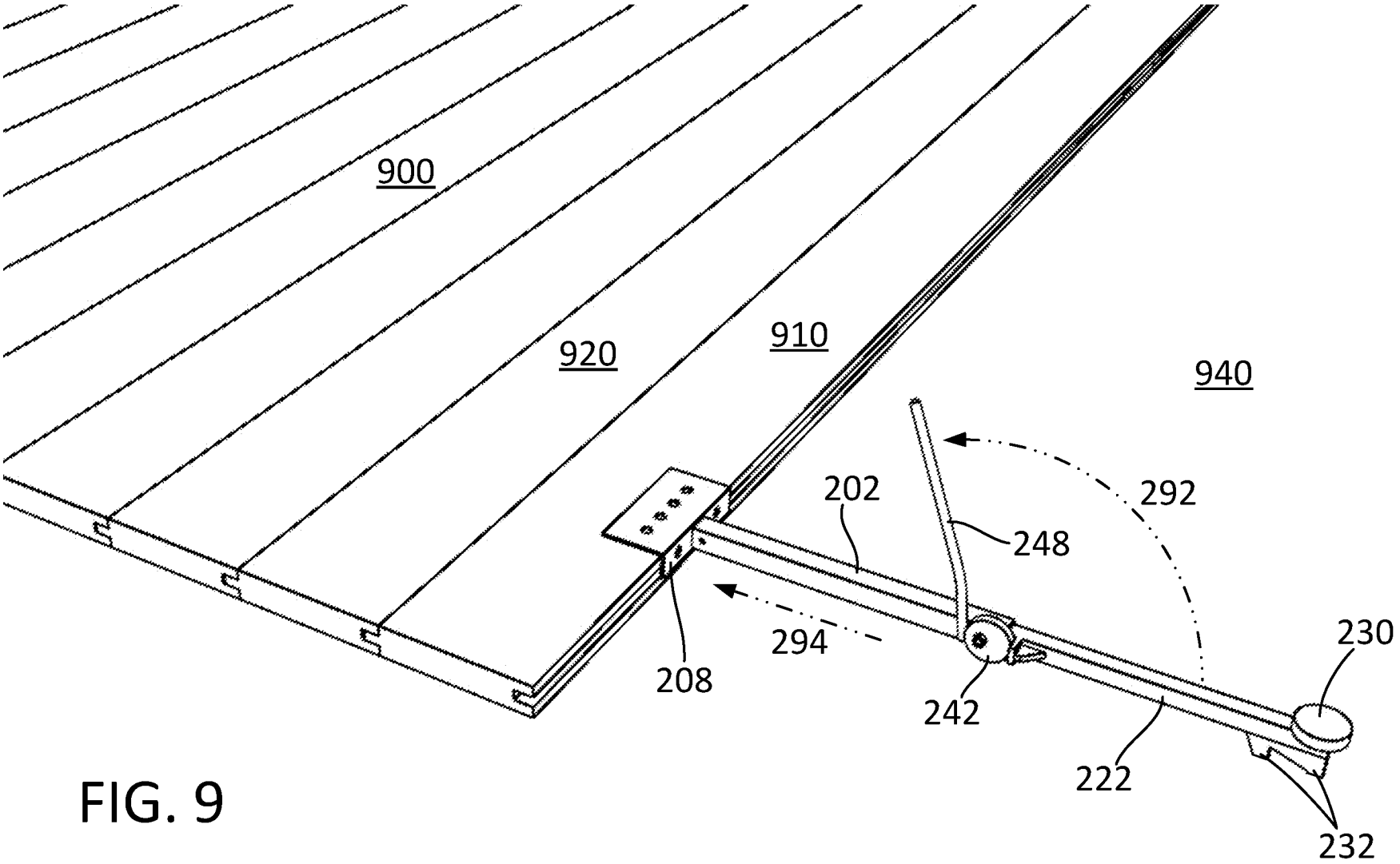
FIG. 9 is an in-use view of a tongue and groove tool, according to an embodiment of the present invention, illustrating a next board in position against a previously installed board after actuating the handle.
Figure 10:
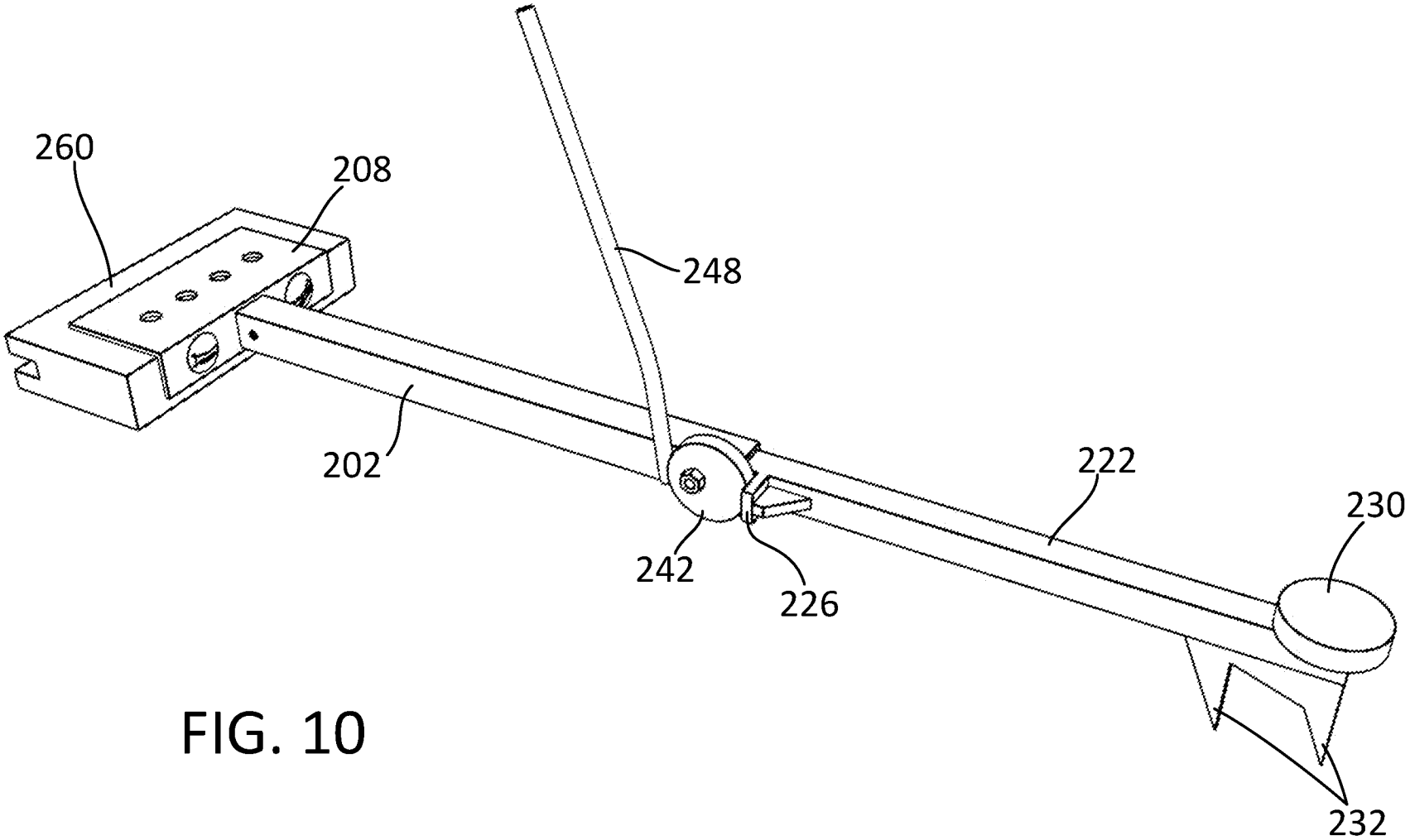
FIG. 10 is an isometric view of a tongue and groove tool, according to an embodiment of the present invention, illustrating the placement of a pusher block to prevent damage to the tongue of a board.

Ordinarily, the invention 100 may be placed at or near the center of the next board 910 and actuated. Alternatively, the invention 100 may be placed in multiple positions along the next board 910 and actuated each time. FIG. 8 and FIG. 9 show the invention 100 closer to the end of the next board 910 for the purpose of illustrating the gap 290 (FIG. 8) and closure of the gap 290 (FIG. 9) during use of the invention 100.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tongue and groove tool, comprising:

a moving armature having a moving armature shaft and a pushing head, the moving armature shaft includes a cam axle that projects laterally away from the moving armature shaft adjacent to a rear end of the moving armature shaft, and the pushing head includes one or more attachment apertures for coupling the pushing head to an object;

a stationary armature having a stationary armature shaft, a hammer pad, and one or more spikes, the hammer pad is a target for striking with a hammering tool to drive the one or more spikes into a substructure to anchor the stationary armature;

a cam armature operable to push the moving armature forward relative to the stationary armature, the cam armature includes a cam disk and a handle, the handle is an armature that is operable to provide leverage while rotating the cam disk; and a spring pulling the stationary armature and the moving armature together as the handle is lowered from a vertical position to a horizontal starting position.

2. The tongue and groove tool, according to claim 1, wherein the moving armature shaft is a straight and hollow shaft.

3. The tongue and groove tool, according to claim 1, wherein the pushing head is coupled to a front end of the moving armature shaft.

4. The tongue and groove tool, according to claim 1, wherein the moving armature shaft includes a first set of pin apertures that pass laterally through a plurality of sides of the moving armature shaft adjacent to the pushing head.

5. The tongue and groove tool, according to claim 4, wherein a front of the spring is coupled to the moving armature via a front spring pin which slides through the first set of pin apertures located on the moving armature.

6. The tongue and groove tool, according to claim 1, wherein the pushing head is an L-shaped armature that is operable to push against a next board.

7. The tongue and groove tool, according to claim 1, wherein a rear of the pushing head is coupled to the moving armature shaft and a top of the pushing head rests upon on top of the next board during use.

8. The tongue and groove tool, according to claim 1, wherein the moving armature is slidably coupled to the stationary armature such that the moving armature slides forward and rearward relative to the stationary armature.

9. The tongue and groove tool, according to claim 1, wherein the moving armature shaft and the stationary armature shaft are square tubing and a plurality of inside dimensions of the moving armature shaft are larger than a plurality of outside dimensions of the stationary armature shaft such that the stationary armature shaft slide into and out of the moving armature shaft.

10. The tongue and groove tool, according to claim 1, wherein the stationary armature shaft includes a thrust ledge that projects laterally away from a midpoint of the stationary armature shaft.

11. The tongue and groove tool, according to claim 10, wherein the thrust ledge presents a flat surface that is perpendicular to the stationary armature shaft at the front of the thrust ledge such that the cam disk pushes against the flat surface during use.

12. The tongue and groove tool, according to claim 1, wherein the stationary armature shaft includes a second set of pin apertures that pass laterally through the sides of the stationary armature shaft adjacent to the front of the stationary armature shaft.

13. The tongue and groove tool, according to claim 1, wherein the hammer pad is coupled to the top rear of the stationary armature, above the one or more spikes.

14. The tongue and groove tool, according to claim 1, wherein the one or more spikes are one or more downward-pointed projections coupled to the bottom rear of the stationary armature and are pressed into the substructure to prevent the stationary armature from moving forward or rearwards.

15. The tongue and groove tool, according to claim 1, wherein the cam disk is a round disk having a cam disk aperture.

16. The tongue and groove tool, according to claim 15, wherein the cam disk is rotationally coupled to the cam axle of the moving armature via the cam disk aperture.

17. The tongue and groove tool, according to claim 15, wherein the cam disk aperture is located off-center such that a point on the perimeter of the cam disk does not follow a circular path around the center of the cam disk when the cam disk rotates.

18. The tongue and groove tool, according to claim 1, further comprising a working curve of the cam disk pushes against the thrust ledge of the stationary armature when the cam armature is actuated.

19. The tongue and groove tool, according to claim 1, wherein a front end of the handle is coupled to the cam disk such that as the handle is lifted from a horizontal starting position to a vertical position, the cam disk rotates to push the thrust ledge away from the cam axle.

20. The tongue and groove tool, according to claim 1, wherein a rear of the spring is coupled to the stationary armature via a rear spring pin which slides through the second set of pin apertures located on the stationary armature.

* * * * *